US005729085A

United States Patent [19]

Sica et al.

[11] Patent Number: 5,729,085

[45] Date of Patent: Mar. 17, 1998

[54] FLUORESCENT LAMP WITH A PROTECTIVE ASSEMBLY

[75] Inventors: Michael F. Sica, Greenwich, Conn.; Herbert Needham, Toms River; James Parascondola, Franklin Lakes, both of N.J.

[73] Assignee: Royal Lite Manufacturing and Supply Corp., Belleville, N.J.

[21] Appl. No.: 620,506

[22] Filed: Mar. 22, 1996

[51] Int. Cl.[6] ..... H01J 17/18

[52] U.S. Cl. ..... 313/493; 313/634; 313/625

[58] Field of Search ..... 313/493, 634, 313/25, 623, 624, 625

[56] References Cited

U.S. PATENT DOCUMENTS

| | | |
|---|---|---|
| 2,135,696 | 11/1938 | Baumhauer et al. . |
| 2,363,109 | 11/1944 | Keiffer . |
| 2,581,959 | 1/1952 | Koehler . |
| 3,358,167 | 12/1967 | Shanks . |
| 3,453,470 | 7/1969 | Hammer . |
| 3,602,759 | 8/1971 | Evans . |
| 3,720,826 | 3/1973 | Gilmore et al. . |
| 3,808,495 | 4/1974 | Win . |
| 4,048,537 | 9/1977 | Blaisdell et al. . |
| 4,916,352 | 4/1990 | Haim et al. . |
| 4,924,368 | 5/1990 | Northrop et al. . |
| 5,173,637 | 12/1992 | Sica . |
| 5,536,998 | 7/1996 | Sica ..... 313/493 |

*Primary Examiner*—Sandra L. O'Shea
*Assistant Examiner*—Vip Patel
*Attorney, Agent, or Firm*—Brumbaugh, Graves, Donohue & Raymond

[57] ABSTRACT

A fluorescent lamp has a protective assembly that includes a protective tube preformed from a semi-rigid non-frangible polymeric transparent or translucent material that is stabilized against ultraviolet radiation. The protective tube has a body portion received over the glass tube with a clearance sufficient to enable the glass tube to be slid into the protective tube and a closure portion at each end that is mechanically and thermally deformed permanently to engage an adhesive layer on the terminal cap of the lamp and form a bond therewith such as to provide a mechanical connection that resists separation of the terminal cap from the protective tube and a moisture barrier and hermetic seal between the lamp and the protective tube.

9 Claims, 2 Drawing Sheets

FLUORESCENT LAMP WITH A PROTECTIVE ASSEMBLY

BACKGROUND OF THE INVENTION

When fluorescent lamps break, fragments of the glass tube and powders from the phosphor coating inside the lamp are scattered about. In places where food is processed or stored, and particularly in food-processing plants and lighted display cabinets in supermarkets where stocking clerks and customers handle food in proximity to the cabinet lamps, it is at least highly desirable, and is often required by government regulations, that the lamps be protected in a way that minimizes the possibility of the lamps being broken and if they do break the possibility of glass fragments and phosphor powders escaping and contaminating the food. Fluorescent lamps with protective assemblies are known and widely used for this purpose. Examples of such lamps are those described and shown in U.S. Pat. Nos. 3,453,470 (Hammer, Jul. 1, 1969); 3,602,759 (Evans, Aug. 31, 1971); 3,720,826 (Gilmore et al., Mar. 13, 1973); 3,808,495 (Win, Apr. 30, 1974); 4,048,537 (Blaisdell et al., 1977); 4,924,368 (Northrup et al., 1990); and 5,173,637 (Sica, 1992). The Sica patent is owned by the assignee of the present invention.

In most instances, the prior art protective assemblies for fluorescent lamps include special molded end fittings that fit onto the terminal caps of the lamp and hold a protective sleeve in place on the lamp. In some cases, the end fittings are intentionally designed so that they can be removed from the lamp, thus allowing the protective assembly to be reused as lamps burn out and are replaced. Removable protective assemblies do not fully ensure that glass fragments and phosphor powders are retained in case the lamp breaks, inasmuch as the removable end fitting can be dislodged from the lamp and the protective sleeve. Regardless of whether the end fittings are permanently attached to the lamp or are removable, they are relatively expensive and usually have to be designed for a specific lamp style to ensure a proper fit.

The protective assembly of the Sica patent consists of a protective tube extruded from a polycarbonate resin that is stabilized against ultraviolet radiation and a collar at each end that is shrink-fitted over the flange portion of the respective terminal cap and over an end portion of the protective sleeve. Each collar is bonded to both the terminal cap and the protective sleeve to ensure that the terminal caps, collars and protective sleeve remain intact should the glass tube of the lamp break. The lamp of the Sica patent provides excellent protection against breakage of the lamp, and if the lamp should break, the protective assembly provides an enclosure for the lamp glass tube and terminal caps that is secure against separation, thus preventing release and scattering of glass fragments and phosphor powders. The Sica lamp is relatively inexpensive to produce, inasmuch as it uses simple tubular elements and commercially available adhesives and is simple and quick to assemble.

Although the advantages of the Sica protected fluorescent lamp have made it highly successful commercially, the Sica protective assembly, which includes the protective sleeve and two shrink-fitted collars, one at each end, results in the outside diameter of the protected lamp being significantly greater than that of the unprotected lamp, the maximum diameter being that of the part of each collar that overlies the respective end of the protective tube. Some commercially available fluorescent fixtures do not have enough space to accept the Sica protected lamp. Also, the costs of the two collars and the labor costs of installing them are, of course, elements of the total cost of supplying the protected lamp.

SUMMARY OF THE INVENTION

One object of the present invention is to provide a fluorescent lamp having very effective protection against scattering of glass fragments from the tube and powders from the coating in the event that the lamp breaks. A further object is to provide such protection in a way that does not reduce the light output during the useful life of the lamp due to discoloration or clouding of the protective element. Still another object is to provide a "safety" fluorescent lamp that is easy and inexpensive to produce. Yet another object is to reduce the maximum diameter of the protected lamp without in any way diminishing the effectiveness of the protective assembly in minimizing the chance of breakage of the lamp or in containing glass fragments and phosphor powders and other substances of the lamp if the lamp tube should break. The reduced diameter not only makes the protected lamp fit a greater number of fixtures but facilitates replacements of lamps in fixtures that have the room to accommodate the lamp of the Sica '637 patent. It is also an object of the present invention to reduce the number of parts of the protective assembly and the assembly costs.

The foregoing and other objects are attained, according to the present invention, by a fluorescent lamp having a protective assembly. The lamp may be of a commercially available, conventional construction that includes an elongated glass tube and a metal terminal cap at each end of the glass tube, each cap having a flange portion adjacent the glass tube. The protective assembly comprises an adhesive layer on the flange portion of each terminal cap and a protective tube preformed from a semi-rigid non-frangible polymeric transparent or translucent material that is stabilized against ultraviolet radiation. The protective tube has a body portion that is received over the glass tube with a clearance sufficient to enable the glass tube to be slid into the protective tube when the protective assembly is formed on the lamp and a closure portion at each end that is mechanically and thermally deformed permanently to engage the adhesive layer and form a bond therewith.

In preferred embodiments of the invention, the polymeric material of the protective tube is a polycarbonate, and the protective tube has a wall thickness of about 0.015 inch. The adhesive layer forms a moisture barrier and hermetic seal between the lamp and the protective tube and is, preferably, a layer of a contact adhesive, such as a layer on a substrate of a double-faced contact adhesive tape.

The present invention also includes a method of making a fluorescent lamp with a protective assembly, the lamp being a commercially available lamp of conventional construction. The method comprises the steps of forming an adhesive layer on the flange portion of each terminal cap, providing a protective tube preformed from a semi-rigid non-frangible polymeric transparent or translucent material that is stabilized against ultraviolet radiation, the protective tube having a inner diameter sufficient to enable the glass tube to be received within it with a clearance, sliding the glass tube into the protective tube, and forming a closure portion at each end of the protective tube by mechanically and thermally deforming each end portion of the protective tube permanently so as to engage the adhesive layer and form a bond therewith.

The method, preferably, involves forming each of the closure portions by positioning an end portion of the protective tube that surrounds the corresponding terminal cap flange within a plurality of heated radially movable forming tools, engaging the forming tools with the end portion for a time sufficient to heat the end portion to a temperature above the softening point of the polymeric material, and moving the forming tools substantially radially to displace and deform the end portion of the protective tube so as to engage an inner wall of the end portion with the adhesive layer.

For a better understanding of the invention reference may be made to the following description of an exemplary embodiment, taken in conjunction with the accompanying drawings.

DESCRIPTION OF THE EMBODIMENT

Figure 1:
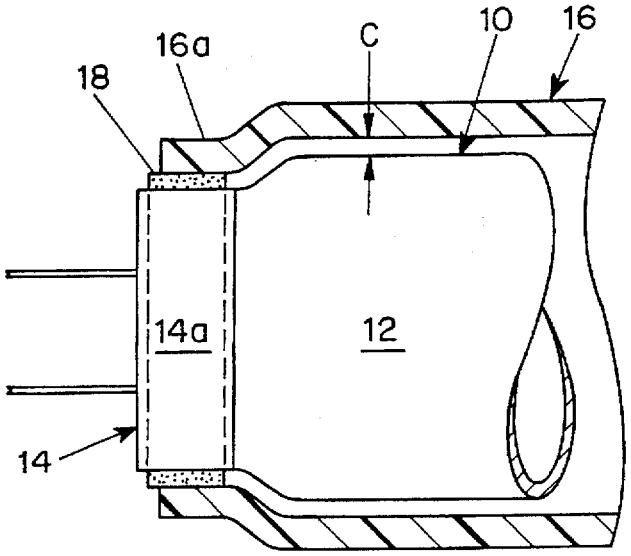
FIG. 1 is a partial side cross-sectional view of an embodiment of a protective assembly as installed on a conventional fluorescent lamp.

Reference numeral 10 designates a conventional, commercially available fluorescent lamp of the type having an elongated glass tube 12 that necks down slightly at each end and is closed at each end by a cup-like terminal cap 14 having a peripheral flange portion 14*a*. The lamp bases may be of the conventional bi-pin (as shown), single pin or recessed double-contact type. The protective assembly consists of a protective tube 16 preformed from a semi-rigid non-frangible transparent polymeric material that is received over the glass tube with a slight clearance "C" between the outer surface of the glass tube 12 and the inner surface of the protective tube 16 and extends lengthwise substantially coextensively with the glass tube and both terminal caps. The clearance or gap "C" between the lamp tube and the protective tube 16 should be kept small so as to maintain heat transfer from the lamp through the protective tube to the environment. The small clearance gap C is provided only for the purpose of permitting the lamp to be easily inserted into the protective tube when the protective assembly is installed on the lamp.

In a specific example of the invention, as applied to a 1.50 in. fluorescent tube, the protective tube 16 is a piece cut to a length such as to extend lengthwise over the entire lamp tube and terminal caps, (but not over the protruding contact pins) from a circular cylindrical tubular extrusion of a polycarbonate resin that is highly stabilized against ultraviolet radiation. The protective tube may be clear or translucent and in either case may be colored or otherwise treated to provide light of the desired characteristics. A suitable clear polycarbonate tubing may be extruded from a resin supplied by Miles, Incorporated, as Resin No. 3207-1112M50. The protective tube has a wall-thickness of about 0.015 inch, an inside diameter of about 1.517 inch, and an outside diameter of about 1.547 inch. Therefore, on the radius, the clearance or gap C between the outside of the glass tube and the inside of the protective tube is about 0.0085 inch. That clearance permits the lamp to be slid easily into the protective tube when the protective assembly is installed on the lamp.

The protective assembly is assembled on the lamp by first forming an adhesive layer 18 on each cap flange portion 14*a*. Any adhesive that forms a durable bond between the respective terminal cap flange and the protective tube and that is resistant to heat may be used. Advantageously, the adhesive layer is provided by a double-faced tape composed of a substrate having a coating of a contact adhesive on each face. A double-faced tape has the advantages of being easy to apply, avoiding the presence of a liquid or paste substance which can be spilled or misapplied, and of providing the adhesive exactly where it is desired without gaps and without extending to areas where it is not beneficial. A contact adhesive also bonds upon contact, requiring no setting or curing. A suitable double-faced tape with a contact adhesive suitable for the protective assembly is available commercially from 3M Corporation as No. 4693.

Figure 2:
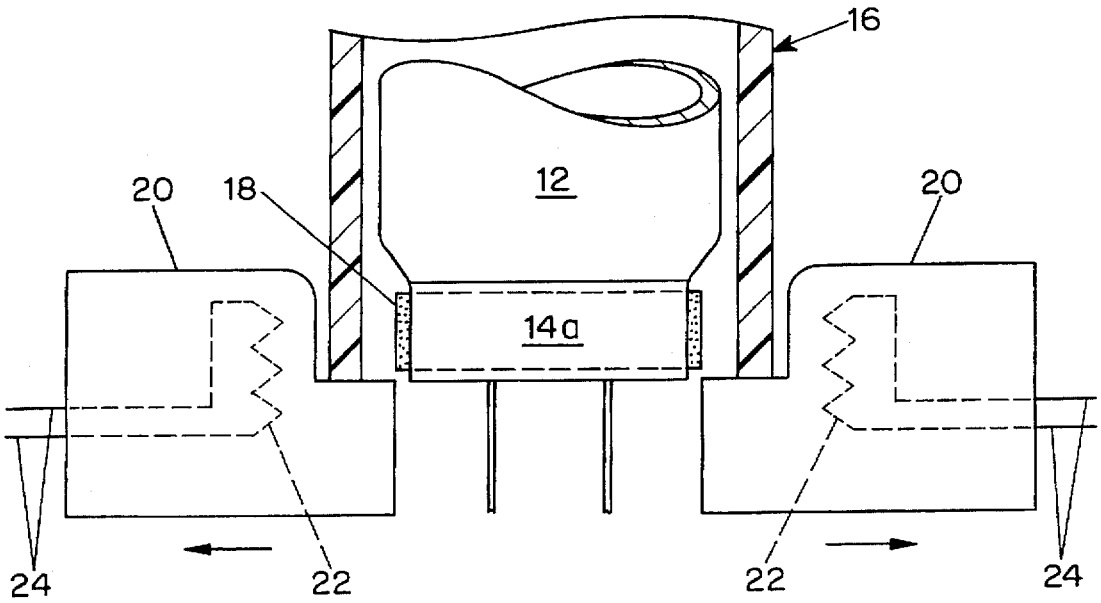
FIGS. 2 and 3 illustrate diagrammatically, by partial side cross-sectional views, the method by which each end of protective sleeve is mechanically and thermally deformed permanently so as to engage the respective terminal cap of the lamp and form a bond with the adhesive layer on the terminal cap.
Figure 3:
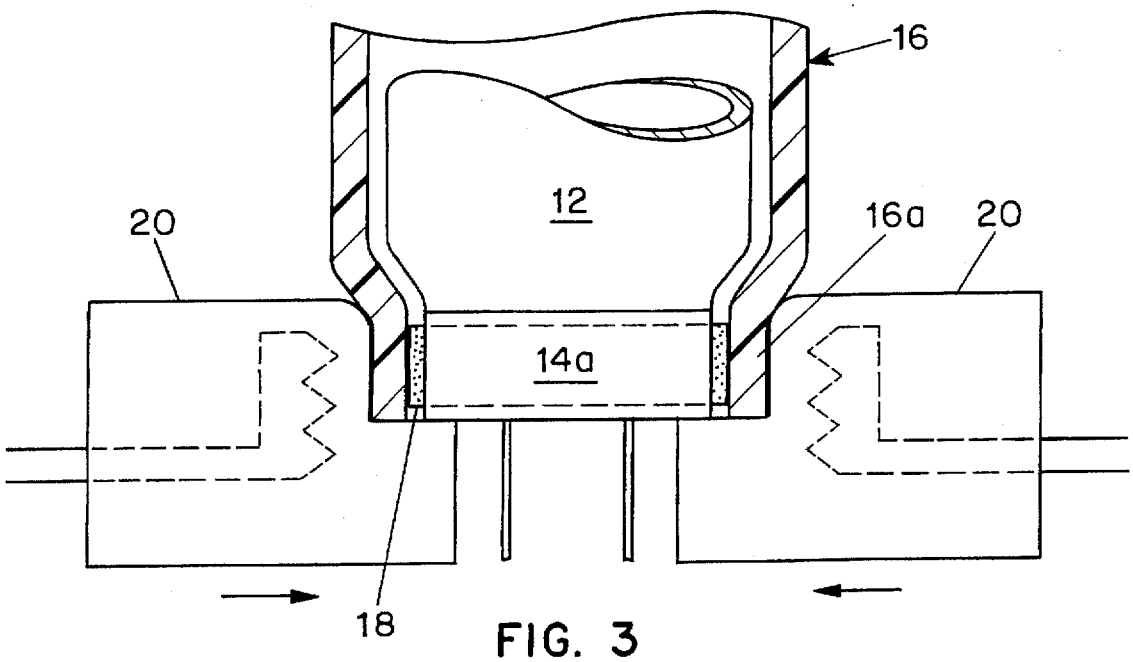

A necked-down closure portion 16*a* is formed on each end of the protective tube 16 that brings the end portion into engagement with the adhesive layer 18 such as to form an adhesive bond, a moisture barrier and a hermetic seal between each terminal cap of the lamp and the protective tube. The closure portion is formed, in particular, by mechanically and thermally deforming the end portions of the protective tube permanently to engage the adhesive layer 18. A shown diagrammatically in FIGS. 2 to 4, the mechanical and thermal deformation of each end portion of the protective tube is produced by the use of tooling that includes a circular array of radially movable forming tools 20, each of which is heated, such as by an electrical heating element 22 connected by leads 24 to a power source (not shown). The end portion of the protective tube 16, with the lamp 10 installed, is engaged by the forming tools 20 for a time sufficient to heat the end portion to a temperature above the softening point of the polymeric material of the protective tube. When the end portion of the protective tube is heated sufficiently to enable it to be deformed, the forming tools are moved substantially radially toward the lamp terminal cap 14*a* to displace and deform the end portion of the protective tube so as to engage the inner wall of the end portion with the adhesive layer 18.

Figure 4:
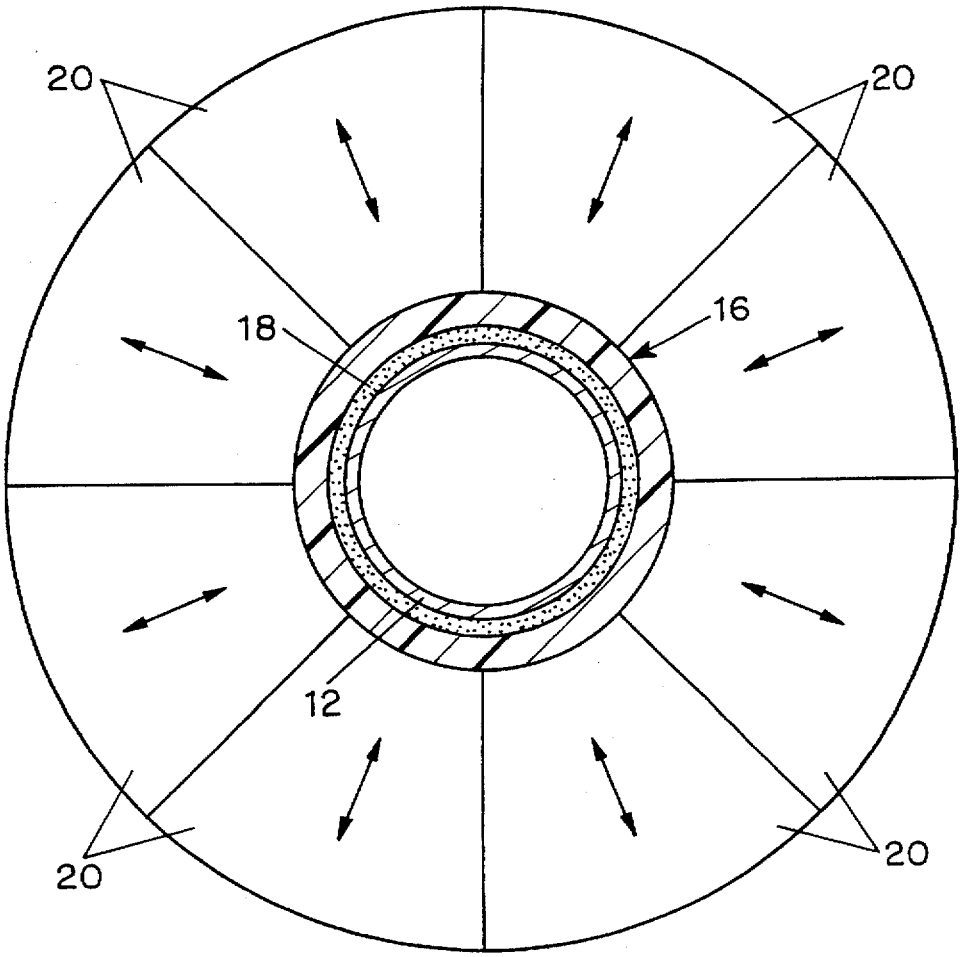
FIG. 4 is a diagrammatic end view illustrating the method shown in FIGS. 2 and 3.

Although FIG. 4 shows the array of forming tools 20 as being essentially continuous circumferentially when moved radially inward to deform the protective tube and form the necked-down closure portions 16*a*, the tools may be spaced apart circumferentially in the inwardly displaced position. In that case, the closure portion is formed by two stages of operation of the tooling or by two sets of tools used in sequence. In a first stage, spaced-apart circumferential segments of the protective tube are deformed to engage and form bonds with the adhesive layer, leaving flute-like projections between the deformed segments. The tools 20 are then retracted, the protective tube and lamp rotated about the lamp axis to bring the fluted segments opposite the tools, and the tools engaged to heat the fluted segments and then displaced inwardly again to deform the fluted segments. The fluted segments fill in and bridge the gaps left between the segments after the first forming stage, thus providing a circumferentially continuous necked-down closure portion 16*a*.

The present invention provides a protective assembly in which a protective tube of a polymeric material resistant to U-V radiation and discoloring mechanically protects the glass lamp tube against impacts and minimizes the chance of it being broken. The end closure portions of the protective tube are mechanically engaged over the necked down parts of the lamp glass tube and adhesively bonded to the respective terminal caps of the lamp. If the protected lamp should break, the protective assembly retains the caps and prevents the dispersal of glass fragments and phosphor powders. The protective assembly does not significantly increase the diameter of the lamp, thus permitting it to be easily installed in most available fluorescent lamp fixtures. It is relatively inexpensive to make, using only small lengths of tape and a single protective tube. The cost of the tooling for forming the closure portions of the protective tube is small, when amortized over long periods of use on a per lamp basis. Installing the protective assembly is quick and easy, thus minimizing labor costs.

I claim:

1. A fluorescent lamp with a protective assembly, the lamp having an elongated glass tube and a metal terminal cap at each end of the glass tube and each cap having a flange portion adjacent the glass tube, comprising an adhesive layer on the flange portion of each terminal cap, and a protective tube preformed from a semi-rigid non-frangible polymeric transparent or translucent material that is stabilized against ultraviolet radiation, the protective tube having a body portion received over the glass tube with a clearance sufficient to enable the glass tube to be slid into the protective tube and a necked-down closure portion at each end that is mechanically and thermally deformed permanently to engage the adhesive layer and form a bond therewith.

2. A fluorescent lamp according to claim 1 wherein the polymeric material of the protective tube is a polycarbonate.

3. A fluorescent lamp according to claim 2 wherein the protective tube has a wall thickness of about 0.015 inch.

4. A fluorescent lamp according to claim 1 wherein the adhesive layer forms a moisture barrier and hermetic seal between the lamp and the protective tube.

5. A fluorescent lamp according to claim 1 wherein the adhesive of the adhesive layer is a contact adhesive.

6. A fluorescent lamp according to claim 1 wherein the adhesive layer is a layer on a substrate of a double-faced contact adhesive tape.

7. A fluorescent lamp according to claim 1 wherein the polymeric material of the protective tube is a polycarbonate, the protective tube has a wall thickness of about 0.015 inch, and the adhesive layer forms a moisture barrier and hermetic seal between the lamp and the protective assembly.

8. A fluorescent lamp according to claim 7 wherein the adhesive of the adhesive layer is a contact adhesive.

9. A fluorescent lamp according to claim 7 wherein the adhesive layer is a layer of contact adhesive on a substrate of a double-faced contact adhesive tape.

* * * * *